US010335845B2

(12) United States Patent
Sohmshetty et al.

(10) Patent No.: US 10,335,845 B2
(45) Date of Patent: Jul. 2, 2019

(54) HOT-STAMPING FURNACE AND METHOD OF HOT STAMPING

(71) Applicant: Ford Global Technologies, LLC, Dearborn, MI (US)

(72) Inventors: Raj Sohmshetty, Canton, MI (US); Constantin Chiriac, Windsor (CA); S. George Luckey, Jr., Dearborn, MI (US); Nia R. Harrison, Ann Arbor, MI (US); Peter A. Friedman, Ann Arbor, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 541 days.

(21) Appl. No.: 15/133,904

(22) Filed: Apr. 20, 2016

(65) Prior Publication Data

US 2017/0304884 A1 Oct. 26, 2017

(51) Int. Cl.

| | |
|---|---|
| ***B21D 22/02*** | (2006.01) |
| ***C21D 1/673*** | (2006.01) |
| ***C21D 6/00*** | (2006.01) |
| ***C21D 9/48*** | (2006.01) |
| ***B21D 22/20*** | (2006.01) |
| *C22C 38/00* | (2006.01) |
| *C22C 38/02* | (2006.01) |
| *C22C 38/04* | (2006.01) |

(52) U.S. Cl.

CPC ..... *B21D 22/022* (2013.01); *B21D 22/208* (2013.01); *C21D 1/673* (2013.01); *C21D 6/005* (2013.01); *C21D 6/008* (2013.01); *C21D 9/48* (2013.01); *C21D 2211/001* (2013.01); *C21D 2211/008* (2013.01); *C21D 2221/00* (2013.01); *C22C 38/002* (2013.01); *C22C 38/02* (2013.01); *C22C 38/04* (2013.01)

(58) Field of Classification Search

CPC ..... F27D 1/1858; F27D 2001/1875

See application file for complete search history.

(56) References Cited

U.S. PATENT DOCUMENTS

| | | | | |
|---|---|---|---|---|
| 3,416,777 | A * | 12/1968 | Alexander, Jr. | F27B 9/22 432/10 |
| 4,972,785 | A * | 11/1990 | Suey | F27D 1/1858 110/173 C |
| 7,578,894 | B2 | 8/2009 | Reinhold et al. | |
| 8,460,484 | B2 | 6/2013 | Loecker et al. | |
| 8,529,250 | B2 | 9/2013 | Schwartz | |
| 8,691,032 | B2 | 4/2014 | Thomas et al. | |
| 2004/0060623 | A1 | 4/2004 | Boke et al. | |

(Continued)

FOREIGN PATENT DOCUMENTS

DE 102013107870 A1 1/2015

*Primary Examiner* — Scott R Kastler

(74) *Attorney, Agent, or Firm* — Ray Coppiellie; Brooks Kushman P.C.

(57) ABSTRACT

A hot-stamping furnace includes a housing defining a heating chamber partitioned into compartments configured to have different temperatures. The heating chamber includes an opening that is at least partially covered by a door movably mounted on the housing. The door is configured to extend over only a portion of the opening when in a closed position. A detachable panel extends from an edge of the door such that the panel extends over a portion of the opening that the door does not extend over.

20 Claims, 6 Drawing Sheets

(56) References Cited

U.S. PATENT DOCUMENTS

| | | | | |
|---|---|---|---|---|
| 2010/0300584 | A1 | 12/2010 | Buschsieweke et al. | |
| 2013/0160906 | A1 | 6/2013 | Bake et al. | |
| 2013/0216969 | A1* | 8/2013 | Schwartz | C21D 9/46<br>432/207 |
| 2013/0313763 | A1 | 11/2013 | Grewe | |
| 2014/0083572 | A1 | 3/2014 | Schwartz | |
| 2015/0225189 | A1 | 8/2015 | Ebner et al. | |
| 2017/0304884 | A1 | 10/2017 | Sohmshetty et al. | |
| 2018/0001367 | A1 | 1/2018 | Chiriac et al. | |

* cited by examiner

HOT-STAMPING FURNACE AND METHOD OF HOT STAMPING

TECHNICAL FIELD

The present disclosure relates to an apparatus and method for manufacturing hot-stamped components suitable for use with motor vehicles. More specifically, a furnace includes multiple heating zones for heating different portions of a blank to different temperatures to create a hot-stamped component having softened zones in select areas to facilitate down-stream assembly of the component to other components of the vehicle.

BACKGROUND

Press-hardened steel alloys are being used for sheet-metal parts incorporated in vehicle body structures that may be assembled together with rivets or welding. One example of a press-hardened steel is boron steel sold under the designation Usibor® 22MnB5. Press-hardened steel can be water cooled or oil cooled to a desired level of hardness from 450 to 520 HV. Press-hardened steel may be annealed to reduce the hardness to 140 HV.

Press-hardened steel parts may be assembled to other steel parts by welding. But, new automotive assemblies may include combinations of parts made of different materials such as aluminum and composite parts. An Ultra High Strength Steel (UHSS) beam formed by press hardening and a composite part or an aluminum part cannot be efficiently joined together in a welding operation. The preferred technique for joining such part assemblies is to rivet or otherwise fasten the parts together. The hardness of such high strength parts poses significant challenges in high volume manufacturing operations because the rivets have difficulty penetrating the UHSS beam.

SUMMARY

According to one embodiment, a hot-stamping furnace includes a housing defining a heating chamber partitioned into compartments configured to have different temperatures. The heating chamber includes an opening that is at least partially covered by a door movably mounted on the housing. The door is configured to extend over only a portion of the opening when in a closed position. A detachable panel extends from an edge of the door such that the panel extends over a portion of the opening that the door does not extend over.

According to another embodiment, a hot-stamping furnace includes a housing defining a heating chamber having an opening. A partition divides the chamber into first and second zones each extending to the opening. The second zone is configured to have a higher temperature than the first zone. A door is mounted to the housing and includes a panel positioned to cover the opening in front of the second zone but not cover the opening in front of the first zone.

According to yet another embodiment, a method of heat treating a component in a furnace is disclosed. The furnace has at least first and second compartments configured to have different temperatures and a door including a panel. The method includes inserting the component through an opening of the furnace such that a first portion of the component is in the first compartment and a second portion of the component is in the second compartment. The method also includes heating the first compartment to a temperature calculated to heat the first portion of the component above an AC3 temperature within a predetermined time, and heating the second compartment to a temperature calculated not to heat the second portion of the component above an AC1 temperature within the predetermined time. The method further includes closing the door over the opening such that the door only partially covers the opening and such that the panel fully covers the opening in front of the first compartment and does not cover the opening in front of the second compartment.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
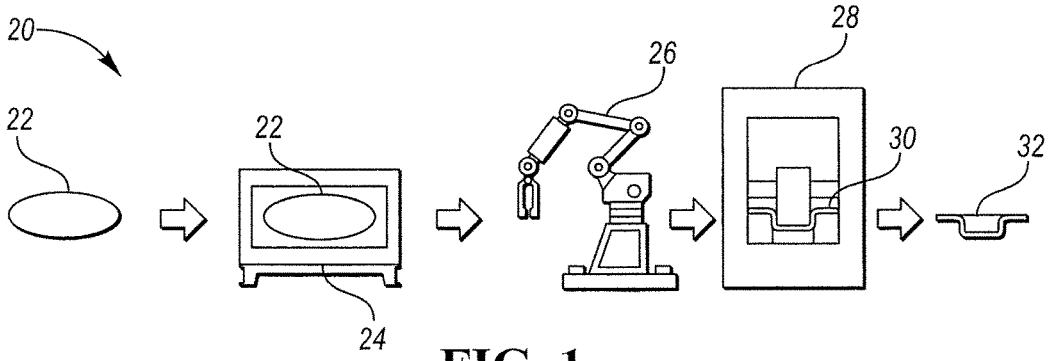
FIG. 1 is illustrates an example hot-stamping process.

Referring to FIG. 1, a hot-stamping process 20 is shown for manufacturing an DHSS vehicle body component. Hot stamping, also known as hot forming or press hardening, is a process of stamping a blank while the metal is very hot, usually in excess of 900° C., and subsequently quenching the formed blank in the closed die. The hot-stamping process converts low-strength blanks to high-strength components. For example, the finished component may have a yield strength of about 150 to 230 kilo pounds per square inch (KSI).

In the example process 20, a boron steel blank 22 (which is a press-hardenable steel) is placed in a furnace 24 and heated above AC3 forming austenite. AC3 is the transformation temperature at which ferrite fully transforms into austenite. For example, the blank 22 may be heated at 900 to 950° C. for a predetermined time in the furnace 24. The bake time and furnace temperature varies depending upon the material of the blank 22 and the desired properties of the finished part. After heating, a robotic transfer system 26 may transfer the austenized blank 22 to a press 28 having a die arrangement 30. The die arrangement 30 stamps the blank 22 into a desired shape while the blank 22 is still hot to form one or more components 32 from the blank 22. The component 32 is then quenched while the die 30 is still closed using water or other coolant means. Quenching is provided at a cooling speed of 20 to 150° C./sec. for a predetermined duration at the bottom of the stroke. Quenching changes the microstructure of the blank from austenite to martensite. After quenching, the component 32 is removed from the press 28 while the component is still hot (e.g., about 150° C.). The component 32 may then be cooled on racks.

Hot stamping may provide numerous advantages over other high-strength steel forming methods such as cold stamping. One advantage of hot stamping is reduced spring back and warping. Hot stamping also allows complex shapes to be formed in a single stroke of the die. This reduces downstream processing and may increase efficiency in the manufacturing of the vehicle body component.

Hot-stamped components have found broad application in the automotive industry. Hot-stamping components are both lightweight and strong. Example automotive components formed by hot stamping may include: body pillars, rockers, roof rails, bumpers, intrusion beams, carrier understructure, mounting plates, front tunnels, front and rear bumpers, reinforcement members, side rails, and other parts that are designed to resistance deformation during an impact.

Hot-stamped components may be difficult to join to other components. For example, a hot-stamped component may need to be fastened to another component via a self-piercing rivet. Due to their high strength and low ductility, it may be difficult for the rivet to penetrate through the martensite microstructure of the hot-stamped component. In another example, the hot-stamped component may need to be welded to a mild-steel component. Welding the hot-stamped component to the mild-steel component may be unfeasible.

In order to solve these and other problems, a special furnace may be utilized to form softened zones in the blank at select locations. These softened zones remain soft during the stamping and quenching phases and are also present in the finished component. The softened zones are specifically placed in locations where the component is to be attached to other components. The softened zones may have a microstructure consisting of ferrite and perlite, which have lower yield strength and a higher ductility as compared to martensite. For example, the softened zones may have 30-40% less yield strength, and 30-40% more ductility. A self-piercing rivet can more easily penetrate through the softened zones due to the lower yield strength and the higher ductility present in the zone. The material properties at the softened zones also facilitate welding of the press-hardened component to mild steel or aluminum components. Used herein "softened zone" or "soft zone" is to be construed to mean any area of a component that is not fully austenized.

Steel must be fully austenized in order to from martensite. If portions of the blank remain below AC3, then martensite will not be formed in those areas during quenching. Thus, the softened zones can be created by not heating the zones above the temperature at which austenite begins to form (AC1). An Example AC1 temperature is 800° C.

Figure 2:
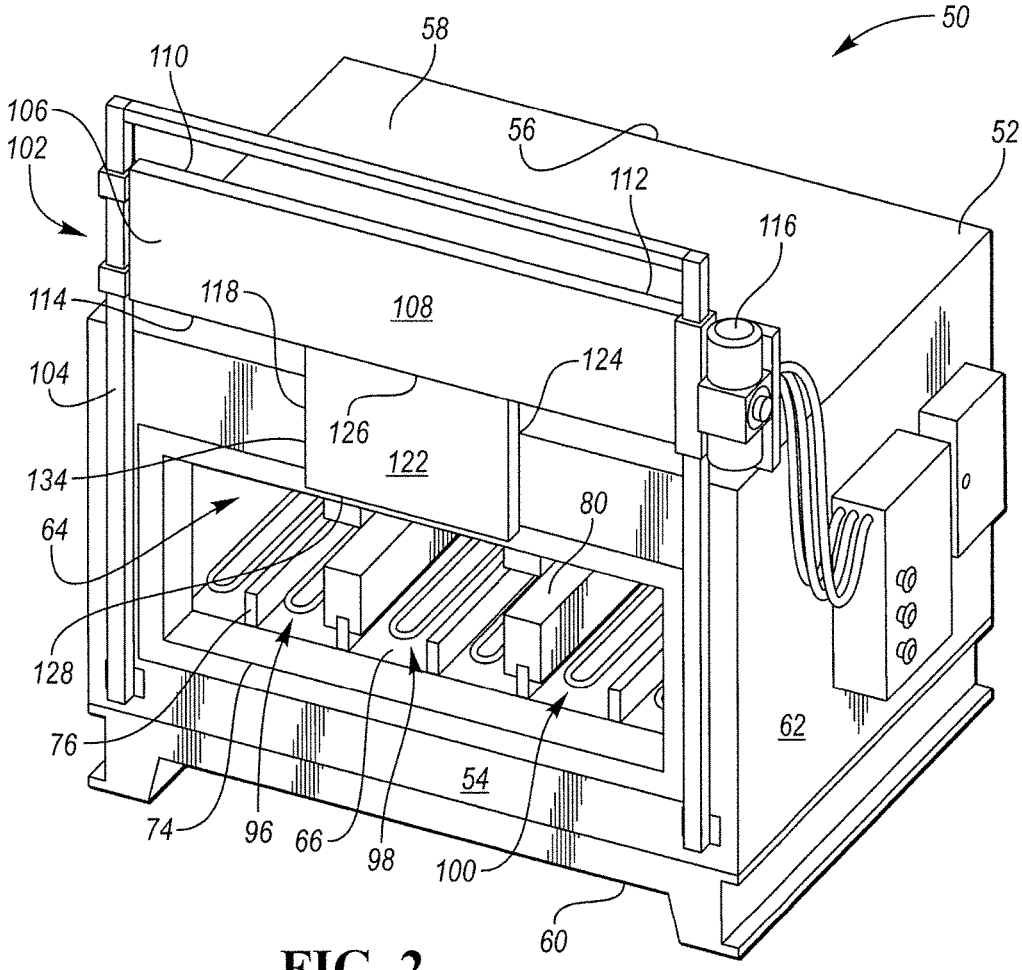
FIG. 2 is a perspective view of an example furnace used in the hot stamping process.
Figure 3:
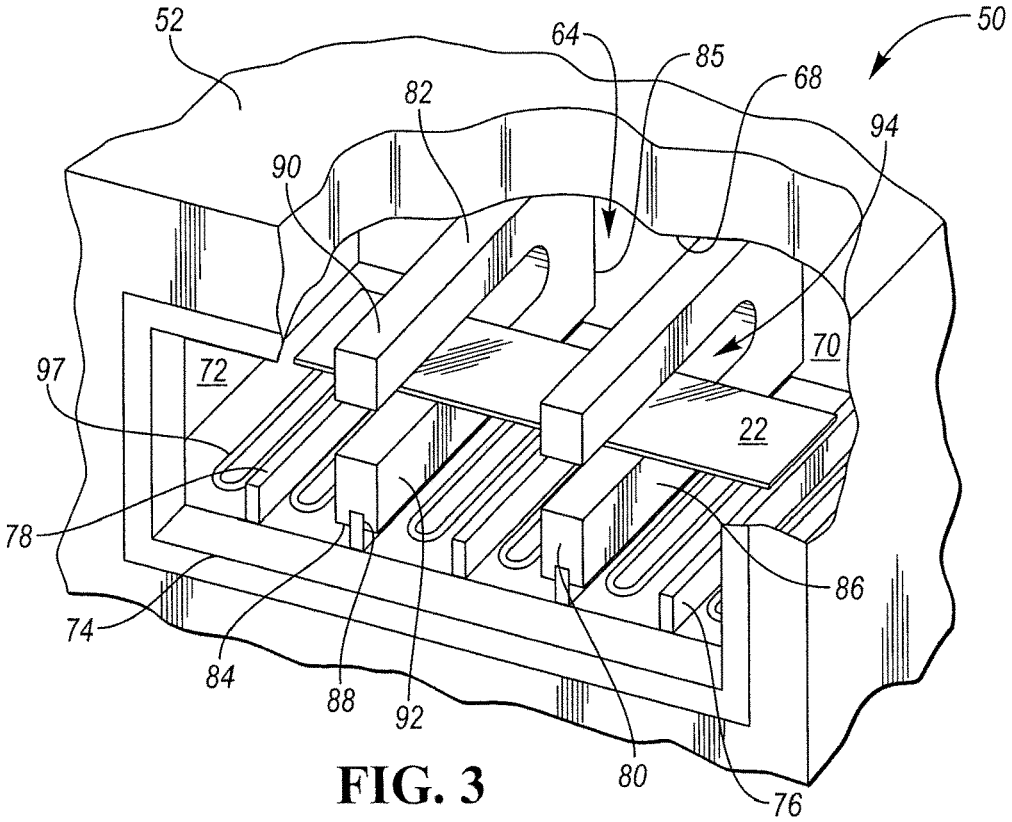
FIG. 3 is a diagrammatical perspective view of a portion of the heating chamber of the furnace.

The figures and related text disclose example furnaces configured to heat different portions of the blank 22 to different temperatures in order to create the softened zones at select locations. Referring to FIGS. 2 and 3, a furnace 50 includes a housing 52 having a front 54, a back 56, a top 58, a bottom 60, and opposing sidewalls 62 that are interconnected to define a heating chamber 64. The heating chamber 64 is configured to receive a blank therein and heat the blank to a desired temperature or temperatures. The heating chamber 64 includes a floor 66, a ceiling 68, a back 70, and opposing sidewalls 72. The heating chamber 64 includes an opening 74 defined in the front 54. The blank is received into and out of the heating chamber through the opening 74. A plurality of locating features 76 is disposed on the floor 66. For example, multiple pillars 76 are disposed on the floor 66 with each extending upwardly towards the ceiling. The pillars 76 are also spacing elements that create a gap above the floor 66 for the heating elements. The pillars prevent the blank from inadvertently contacting the heating elements. The pillars also act as a platform to which other components may be attached.

The furnace 50 may be configured to have multiple chambers or zones of different temperature within the heating chamber 64 to heat different portions of the blank to different temperatures. One way to create the zones is to physically divide the heating chamber 64 into separate compartments or zones. For example, one or more partitions 80 are disposed within the heating chamber 64 to divide heating chamber into at least two compartments. The partition 80 may include a top surface 82 that engages or nearly engages the ceiling 68 of the chamber 64, and a bottom surface 84 that engages with one of the pillars 76. In one embodiment, the bottom surface 84 defines a groove 88 that receives a top surface 78 of the pillar 76 to connect the partition 80 to the pillar 76. The partition 80 also includes a rear surface 85 that engages, or nearly engages, the back 70. Thus, the partition 80 extends between the floor 66 and the ceiling 68, and extends between the back 70 and the opening 74 to fully divide the heating chamber 64. The partition 80 includes major sides 86 that each forms a boundary of one of the zones. The partitions 80 also define a part receiving area 94. The part receiving area 94 may be a slot or similar feature that receives the blank therein to support the blank within the heating chamber 64. In the illustrated embodiment, each of the partitions 80 includes a top portion 90 and a bottom portion 92 that cooperate to define a slot 94. The partitions 80 are modular structures that can be moved around within the heating chamber 64 to create different heating-zone configurations. The heating chamber 64 includes the plurality of pillars 76 to provide a plurality of different placement locations for the partitions 80. It is understood that the heating chamber 64 may include more or less than three different zones.

In the illustrated embodiment, the furnace 50 includes a pair of partitions 80 that divide the heating chamber 64 into a first zone 96, a second zone 98, and a third zone 100. Each of the zones may be set to a different temperature, or two of the zones may be a same temperature and the third zone is a different temperature. The first zone 96 may be a cooler zone that is set below the AC1 temperature (e.g., below 850° C.), and/or is set to a temperature calculated to not heat the blank above the AC1 temperature within the predetermined baking time. The third zone 100 may also be a cooler zone. The second zone 98 may be a hotter zone that is set at or above the AC3 temperature (e.g., above 900° C.), and/or is set to a temperature calculated to heat the blank above the AC3 temperature within the predetermined baking time. It is understood that the heating chamber 64 may include more or less than three different zones by increasing or decreasing the number of partitions. Each of the zones may include its own set of heating elements 97. Each set of heating elements 97 may be independently controlled to a different temperature by a control module of the furnace 150. The heating element may be electric heating elements or may be infrared heating elements for example.

The furnace 50 includes a movable door 102 that may be mounted on the front 54 to cover the opening 74 reducing heat loss from the heating chamber 64 through the opening 74. The door 102 is movable between an open position, a close position and a plurality of in-between positions. The term "closed position" does not necessarily mean that the door 102 fully covers the entire surface area of the opening 74. For example, the door may be configured such that in the closed position it only partially covers the opening 74. The door 102 may be a sliding door that moves up-and-down along vertical door tracks 104 to move between the open and closed positions. In other embodiments, the door may swing between the open and closed position along hinges. The door tracks 104 may be disposed on the front 54. A door actuator 116, such as mechanical gear motor or hydraulic cylinder, moves the door up-and-down along the tracks. The door 102 may include a planar body 106 defining a front panel 108 that faces away from the furnace 50, a back panel 110 that faces the opening 74, a top edge 112, and a bottom edge 114. The door 102 may be shaped as a rectangular, plate-like structure (as shown) or may be any shape known by a person skilled in the art.

Figure 4:
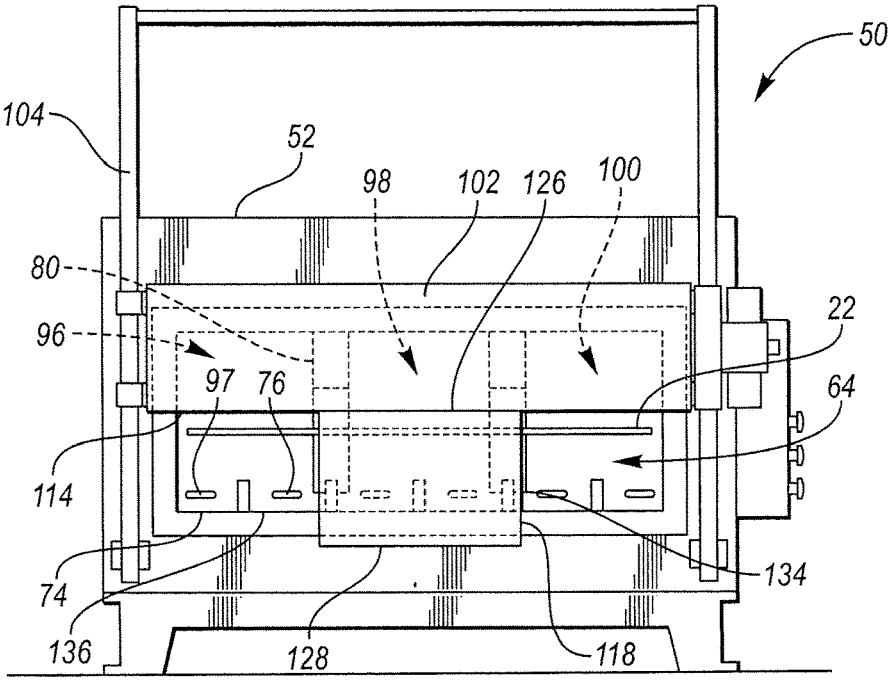
FIG. 4 is a diagrammatical front view of the furnace.

Referring to FIG. 4, the door 102 may include one or more panels 118 that extend from the door 102 to increase the surface area of the door in front of the opening to reduce heat loss from the chamber 64 in select areas—such as in front of a hot zone. The panels 118 cover over areas of the opening that the door does not cover. The panels 118 may be substantially parallel to the door 102 and, in some cases, may be substantially coplanar with the door. In some embodiments, the panels are integrally formed with the door 102 and, in other embodiments, they are removable components that are attached to the door using any means known in the art such as fasteners, welding, and interlocking features. The panels 118 may be modular components that can be added or removed from the door according to the heating requirements of the furnace 50. This allows a base furnace to be easily configured for a multitude of different components.

In the illustrated example, the heating chamber 64 includes two cooler zones 96, 101 and hotter zone 98. FIG. 4 illustrates the door 102 in the closed position, in which, the bottom edge 114 may be disposed around the vertical midpoint of the opening 74. (The location of the bottom edge 114 may vary based on heating requirements.) A panel 118 extends from the bottom edge 114 past the bottom periphery 136 of the opening 74 to fully cover the opening 74 at the hotter zone 98. The panel 118 may include a planar body 120 defining a top 126, a bottom 128, and opposing sides 134. Front and back surfaces 122, 124 extend between the top, bottom, and sides on opposing faces of the planar body 120. The front surface 122 faces away from the furnace 50 and the rear surface 124 faces the heating chamber 64. The panel 118 may be sized such that the sides 134 are each disposed in front of one of the partitions 80 (i.e., the width of the panel 118 may approximate, or may be slightly larger than, the distance between the partitions) to fully cover the opening of the hotter zone 98.

The illustrated embodiment shows a door that moves downwardly from the open position to the closed position. But, the furnace could also be configured such that the door moves upwardly from the open position to the close position. Here, the panels would extend from the top edge 112 of the door. Of course, the door could also be a hinged door that swings from the open position to the close position. In that case, the panel could be positioned on either the top, or the bottom, depending upon the vertical positioning of the door relative to the opening of the heating chamber.

Figure 5:
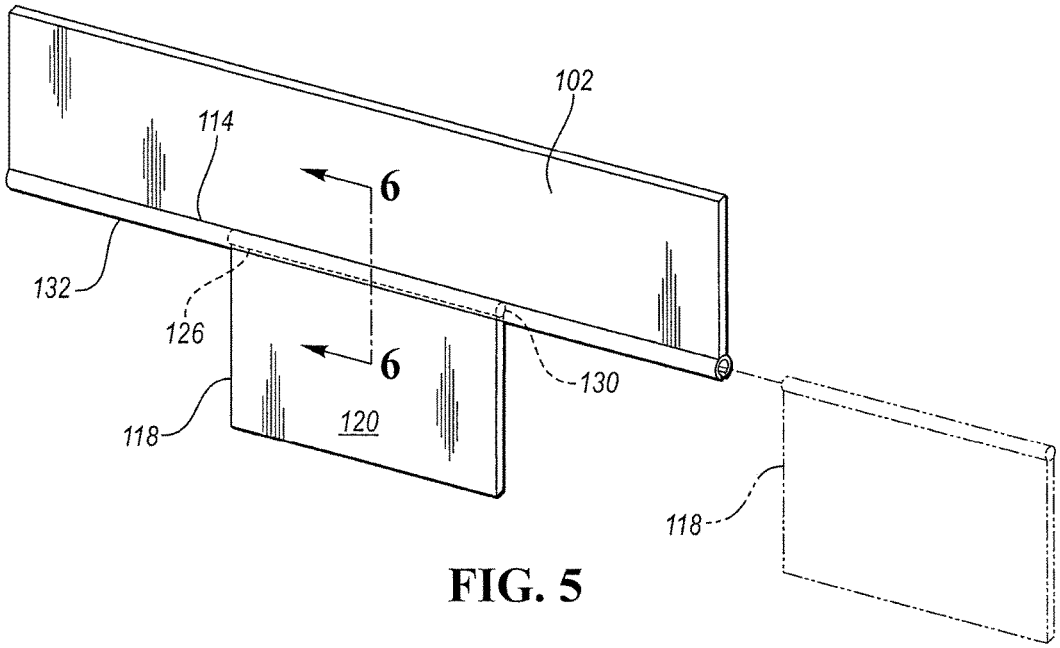
FIG. 5 is a perspective view of an example door assembly of the furnace.
Figure 6:
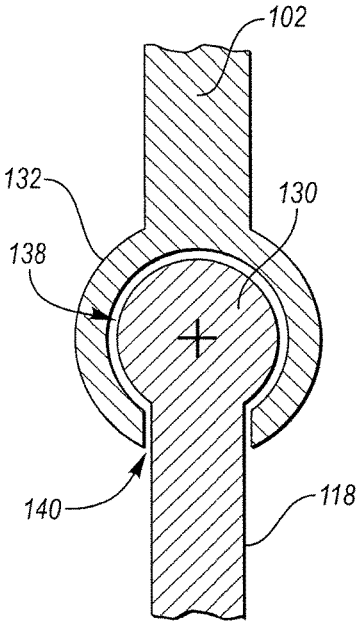
FIG. 6 is a side view, in cross-section, of the door assembly along cut line 6-6.

Referring to FIGS. 5 and 6, the least one modular, and removable panel 118 is slidably connected to a bottom edge 114 of the door 102. The bottom edge 144 may define a journal 132 that receives a head 130 defined in the top 126 of the panel 118. The journal 132 may extend along a length of the bottom edge 114 and may include at least one open end that slidably receives the head 130 of the panel. The journal 132 may be a circular channel 138 that includes a slot 140 extending along a bottom of the channel. The head 130 may be a cylindrical body having a diameter corresponding to an inner diameter of the journal. The body 120 of the panel 118 extends through the slot 140 when installed. The panel 118 is positioned in a desired location by sliding the panel 118 through the journal 132 until the panel is placed in a desired location.

Figure 7:
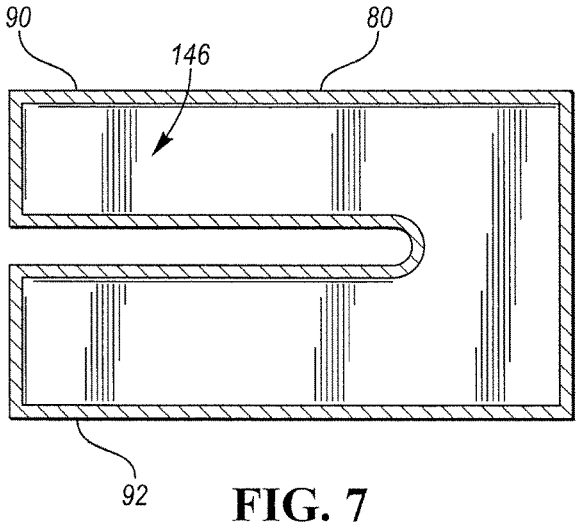
FIG. 7 is a side view, in cross-section, of a portion of the furnace.

FIG. 7 illustrates the partition 80 according to one embodiment that includes a hollow interior 146. The hollow interior 146 increases the thermal isolation between the zones. The hollow interior 146 may be throughout the entire partition 80 as shown, or may be located in only selects portions of the partition. The partition 80 may also include other features that increase the thermal isolation between the zones. For example, the partition 80 may have a reflective surface that reflects radiant energy back into the zone from which it came.

Figure 8:
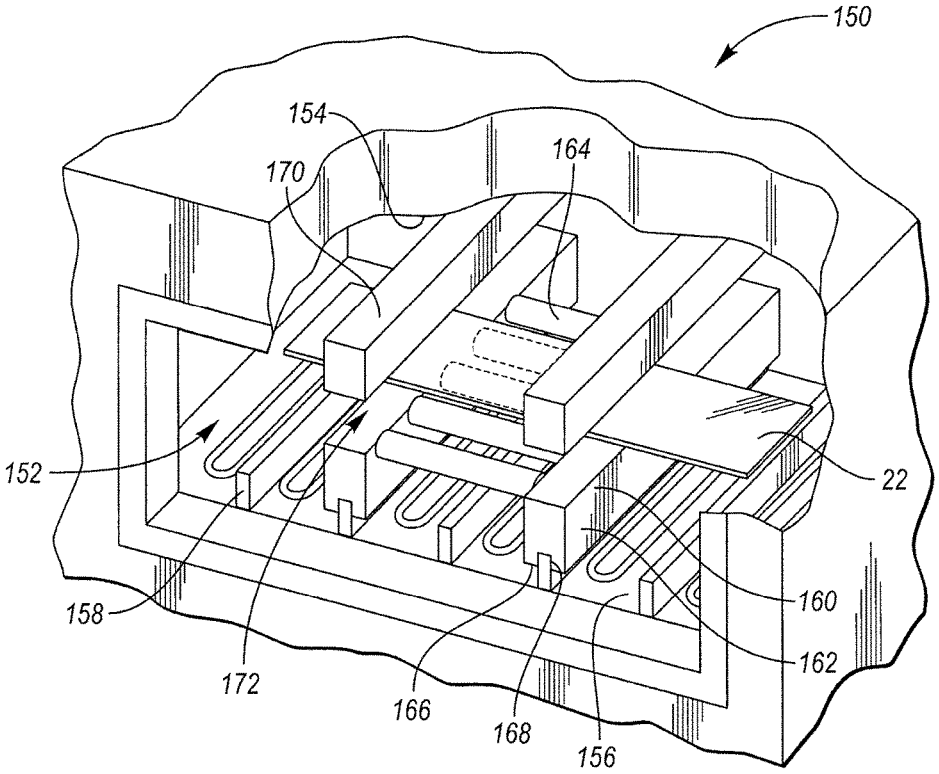
FIG. 8 is a diagrammatical perspective view of another furnace having a roller assembly.

FIG. 8 illustrates another furnace 150 that includes many similar components as the furnace 50 described above. Most of the similar components will not be specifically discussed again here. The furnace 150 includes a heating chamber 152 that is configured to heat a blank to one or more desired temperatures. Similar to furnace 50, furnace 150 is configured to have multiple heating zones or chambers within the heating chamber 152. The heating chamber 152 may be a box-like structure including a ceiling 154, a floor 156, and interconnecting walls. A plurality of pillars 158 extend upwardly from the floor 156. A roller assembly 160 may be disposed within the heating chamber 152 allowing the blank to be rolled into and out of the heating chamber 152. This may make it easier to insert and remove the blank from the furnace. The roller assembly 160 may include a pair of frame members 162 each defining a bottom surface 166. The bottom surface 166 of each frame member 162 is disposed on a top of one of the pillars 158. The bottom surface 166 may define a slot 168 that receives a top portion of the pillar 158. Multiple rollers 164 extend between the opposing frame members 162. In order to divide the heating chamber 152 into multiple chambers or zones, one or more partitions 170 may be attached to the ceiling 154 and extend downwardly towards the roller assembly 160. The partition 170 may be vertically aligned with one of the frame members 162 to define a part receiving area 172. The part receiving area 172 may be a gap that is defined between the frame member 162 and the partition 170. The gap 172 may include a vertical height that approximates the thickness of the blank, albeit slightly larger. The partition 170 and the frame member 162 cooperate to divide the heating chamber 152 into multiple zones by blocking radiant energy.

Figure 9:
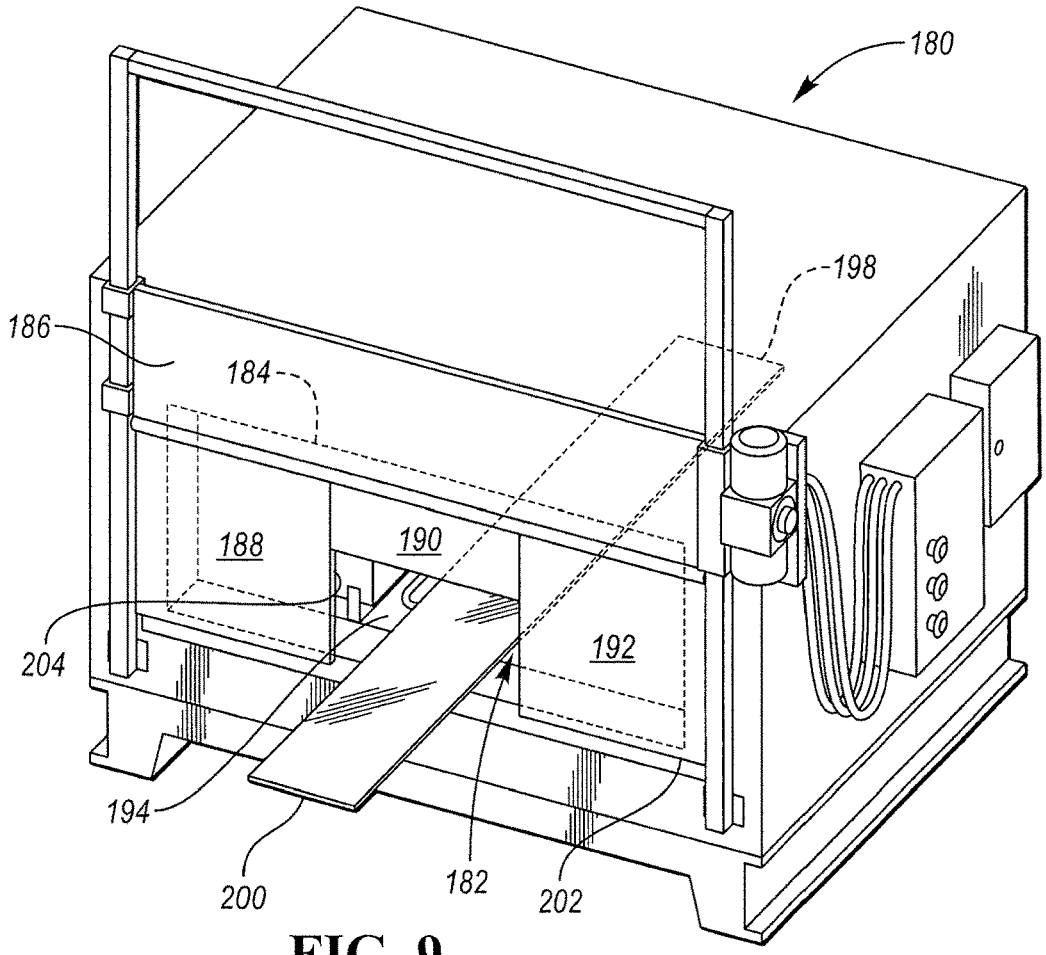
FIG. 9 is a perspective view of yet another furnace.

Referring to FIG. 9, another furnace 180 includes heating chamber 182 having an opening 184. A door 186 is mounted to a face of the furnace 180 and is movable from an opened position to a closed position to cover at least a portion of the opening 184. The door 186 may be a sliding door as described above. The door may be configured to only cover a portion of the opening 184 when in the closed position. One or more panels may extend from the door in order to cover portions of the opening that the door does not cover. For example, the door 186 may include a first panel 188, a second panel 190, and a third panel 192. The panels may be of a uniform size, or may be sized differently. In the illustrated embodiment, the first and third panels 188, 192 are the same size, and the second panel 190 is shorter. Each of the panels may depend from a bottom edge of the door 186, and each may include a bottom edge 202. The first and third panels 188, 192 may extend downwardly from the door such that the bottom edge 202 is lower than the floor 194 of the heating chamber 182 when the door is in the closed position. The second panel 190 may extend downwardly from the door such that the bottom edge 202 is above the floor 194 to define an opening 204 through which a blank may be inserted.

In one embodiment, the heating chamber 182 may be configured to have a generally uniform temperature (i.e., a single zone). Here, a blank 196 is inserted into the heating chamber 182 such that a first portion 198 of the blank is disposed within the heating chamber, and a second portion 200 of the blank is external to the heating chamber 182. The opening 184 acts as a window allowing the second portion 200 to extend out of the heating chamber 182 as shown in FIG. 9. The first portion 198 corresponds with a portion of the finished component that is to be DHSS, and the second portion 200 corresponds with a portion of the finished component that is to be softer steel. Because the first portion 198 is disposed within the oven, the first portion is heated above the AC3 temperature to austenized the first portion allowing the first portion to be martensite after proper quenching is complete. The second portion 200 is not disposed in the oven and never reaches the AC1 temperature. Thus, martensite will not form during quenching.

In another embodiment, the heating chamber 182 may be configured to have multiple heating zones as described above with reference to FIGS. 2 and 3. The first and third panels 188, 192 may cover over the hotter zones, and the second panel 190 is positioned to cover the cooler zone. The opening 204 allows heat to escape from the cooler zone. The zones may be divided by partitions as described above.

Figure 10:
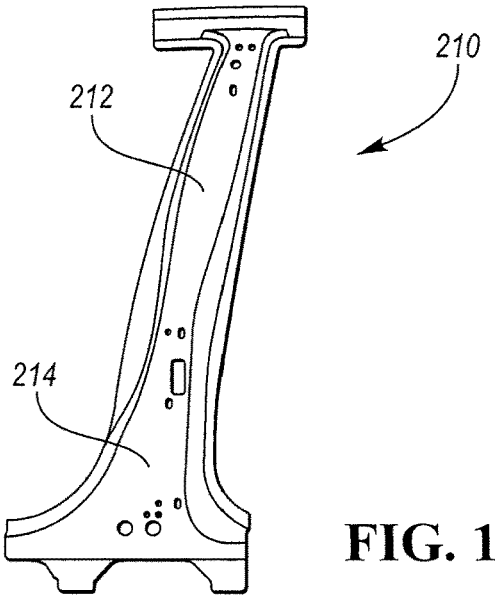
FIG. 10 is a perspective view of a B-pillar.

FIG. 10 illustrates a finished component fabricated using a hot-stamping process that employs a furnace capable of variable heating. The component may be B-pillar 210 that mostly consists of DHSS 212, which has a fully martensite crystal structure. The B-pillar 210 may be fastened to another component using a self-piercing rivet for example. To facilitate the riveting process, the B-pillar 210 includes a soft zone 214 in the area to be riveted. The soft zone 214 consisting of perlite and/or ferrite. The soft zone 214 corresponds to a portion of the blank that was disposed in a cooler zone of the heating chamber and not heated above AC1. The high-strength zone 212 corresponds to a portion of the blank that was in a hotter zone of the heating chamber and was heated above AC3. The soft zone 214 may also be located in a location where the B-pillar is being welding to a non-DHSS component.

Figure 11:
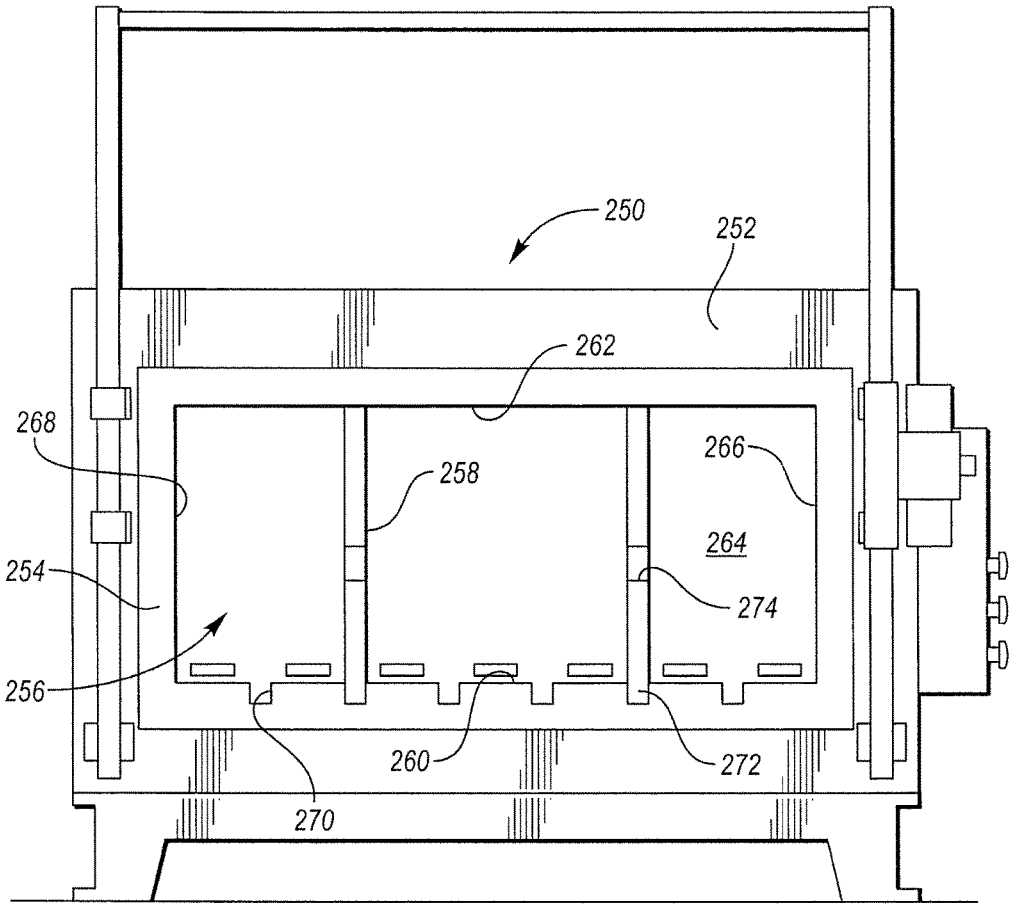
FIG. 11 is a front view of yet another furnace.

FIG. 11 illustrates yet another furnace 250. The furnace 250 includes a housing 252 that may be a rectangular body having a front face 254, a back, a top, a bottom, and sidewalls. The housing 252 defines a heating chamber 256 that receives a blank therein to heat the blank to a desired temperature or temperatures. The heating chamber 256 includes a floor 260, a ceiling 262, a back 264, and opposing sidewalls 266. The heating chamber 256 includes an opening 268 defined in the front face 254. The blank is received into and out of the heating chamber through the opening 268. A door (not shown) closes the opening 268 when the door is closed.

The floor 260 defines an array of locating features 270. The locating features 270 may be slots (as shown) or may be projections, brackets or any other feature known in the art. The slots 270 may extend from the back 264 to the front 254. The slots 270 may be spaced along a width direction of the heating chamber 256 (i.e., between the sidewalls 266) at spaced intervals, such as 3, 6, or 9 inch spacing for example.

The heating camber 256 includes one or more partitions 258 that divide the chamber into zones or compartments configured to have a different temperature. Each of the partitions may be a panel-like structure that extends between the floor 260 and the ceiling 262 and between the back 264 and the front face 254. The partitions 258 cooperate with the locating features 270 to locate the partitions within the heating chamber 256. In some embodiments, the locating feature 270 also is an attachment feature. In the illustrated embodiment, a lower portion 272 of each partition is disposed within one of the slots 270 to locate and retain the partition 258 in a desired location. Each of the partitions 258 may define a blank-receiving area 274 as described above in the other embodiments.

While example embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A hot-stamping furnace comprising:

a housing defining a heating chamber having at least one partition dividing the heating chamber into at least first and second zones configured to have different temperatures, wherein the at least one partition defines a slot extending between the first and second zones such that a blank is receivable in the heating chamber with portions of the blank disposed in both the first and second zones, and wherein the heating chamber includes an opening;

a door movably mounted on the housing to extend over only a portion of the opening when in a closed position; and a detachable panel extending from an edge of the door such that the panel extends over a portion of the opening that the door does not extend over.

2. The furnace of claim 1 wherein the door includes a pair of opposing vertical sides and the edge connects between the sides.

3. The furnace of claim 1 wherein the edge is a bottom edge of the door and the bottom edge is above a bottom of the opening when in the closed position.

4. The furnace of claim 3 wherein the panel depends from the bottom edge of the door past the bottom edge of the opening.

5. The furnace of claim 1 wherein the edge defines a journal and the panel defines a head that is slidably received in the journal to attach the panel to the door.

6. A hot-stamping furnace comprising:

a housing defining a heating chamber having an opening;

a partition dividing the chamber into first and second zones each extending to the opening, the second zone being configured to have a higher temperature than the first zone, wherein the partition further defines a slot configured to receive a blank to support the blank in the heating chamber; and a door mounted to the housing and including a panel positioned to cover the opening in front of the second zone but not cover the opening in front of the first zone.

7. The hot-stamping furnace of claim 6 wherein the panel is detachable.

8. A hot-stamping furnace comprising:

a housing defining a heating chamber having an opening;

a pillar extending upwardly from a bottom of the heating chamber;

a partition disposed on a top surface of the pillar, the partition dividing the chamber into first and second zones each extending to the opening, wherein the second zone is configured to have a higher temperature than the first zone; and a door mounted to the housing and including a panel positioned to cover the opening in front of the second zone but not cover the opening in front of the first zone.

9. The hot-stamping furnace of claim 6 wherein the panel is substantially parallel with the door.

10. The hot-stamping furnace of claim 6 wherein the door defines an edge and the panel extends from the edge to a first distance, and further comprising a second panel extending from the edge to a second distance that is less than the first distance.

11. The hot-stamping furnace of claim 6 wherein the partition defines a hollow interior.

12. The hot-stamping furnace of claim 6 wherein the door defines a journal and the panel defines a head that is slidably received in the journal to attach the panel to the door.

13. A hot-stamping furnace comprising:

a housing defining a heating chamber including a front, a back, a ceiling, and a floor having an array of locating features extending between the front and the back and distributed across a width of the floor; and a partition disposed in the chamber such that a lower end of the partition engages with one of the locating features and an upper end is adjacent to the ceiling to divide the chamber into first and a second zones configured to have different temperatures.

14. The furnace of claim 13 wherein the partition defines a part receiving area configured to support the part when placed in the heating chamber.

15. The furnace of claim 13 wherein the partition defines a hollow interior.

16. The furnace of claim 13 wherein the locating features include a pillar extending upwardly from the floor.

17. The furnace of claim 16 wherein the lower end of the partition defines a groove that receives a top of the pillar.

18. The furnace of claim 13 wherein the locating features are slots defined in the floor.

19. The furnace of claim 13 further comprising a second partition disposed in the chamber such that a lower end of the second partition engages with one of the locating features and an upper end of the second partition is adjacent to the ceiling to divide the heating chamber to have a third zone configured to have a temperature that is different than at least one of the first and second zones.

20. The furnace of claim 13 further comprising a door mounted to the housing and including a panel positioned to cover an opening of the heating chamber in front of the second zone but not cover the opening in front of the first zone.

* * * * *